US006010654A

United States Patent [19]

Kent et al.

[11] Patent Number: 6,010,654

[45] Date of Patent: Jan. 4, 2000

[54] METHOD OF MAKING MULTIPLE DOMAIN FIBERS

[75] Inventors: Diane R. Kent; Matthew B. Hoyt, both of Arden; Charles F. Helms, Jr., Asheville, all of N.C.

[73] Assignee: BASF Corporation, Mt. Olive, N.J.

[21] Appl. No.: 09/151,054

[22] Filed: Sep. 10, 1998

Related U.S. Application Data

[62] Division of application No. 08/970,060, Nov. 13, 1997, Pat. No. 5,869,181

[60] Provisional application No. 60/034,746, Jan. 10, 1997.

[51] Int. Cl.[7] ..... D01D 5/253; D01D 5/34; D01F 8/04; D01F 8/12; D01F 8/14

[52] U.S. Cl. ..... 264/172.12; 264/172.15; 264/172.17; 264/172.18

[58] Field of Search ..... 264/172.12, 172.15, 264/172.17, 172.18, 177.13

[56] References Cited

U.S. PATENT DOCUMENTS

| | | | |
|---|---|---|---|
| 3,718,534 | 2/1973 | Okamoto et al. | 428/374 |
| 4,370,114 | 1/1983 | Okamoto et al. | 425/131.5 |
| 5,162,074 | 11/1992 | Hills | 216/83 |
| 5,202,185 | 4/1993 | Samuelson | 428/373 |
| 5,244,614 | 9/1993 | Hagen | 264/78 |
| 5,344,297 | 9/1994 | Hills | 425/131.5 |
| 5,445,884 | 8/1995 | Hoyt et al. | 428/370 |
| 5,458,972 | 10/1995 | Hagen | 428/373 |
| 5,464,695 | 11/1995 | Kawamoto et al. | 428/370 |
| 5,533,883 | 7/1996 | Hodan et al. | 425/131.5 |
| 5,582,913 | 12/1996 | Simons | 428/373 |
| 5,620,797 | 4/1997 | Mallonee | 428/373 |

*Primary Examiner*—Leo B. Tentoni
*Attorney, Agent, or Firm*—Laura D. Nammo

[57] ABSTRACT

Multicomponent fibers have a primary core, and multiple secondary cores equidistantly radially spaced from one another and from the primary core. The primary and secondary cores are entirely embedded within (and thus completely encased by) a primary sheath. Optionally, the primary sheath may be entirely or partly surrounded by a secondary sheath. The primary and secondary cores may be spun from polymers having distinctly different or complementary properties which are surrounded by a sheath or sheaths formed of another polymer(s) which protects the cores.

6 Claims, 2 Drawing Sheets

METHOD OF MAKING MULTIPLE DOMAIN FIBERS

This application is a divisional of application Ser. No. 08/970,060, filed Nov. 13, 1997, now U.S. Pat. No. 5,869, 181, which claims the benefit of U.S. Provisional Application Serial No. 60/034,746, filed Jan. 10, 1997.

FIELD OF INVENTION

The present invention relates generally to synthetic fibers and the techniques by which such synthetic fibers are made. More particularly, the present invention relates to synthetic fibers having multiple distinct polymer domains.

BACKGROUND AND SUMMARY OF THE INVENTION

Multicomponent fibers are, in and of themselves, well known and have been used extensively to achieve various fiber properties. For example, multicomponent fibers have been formed of two dissimilar polymers so as to impart self-crimping properties. See, U.S. Pat. Nos. 3,718,534 to Okamoto et al and 4,439,487 to Jennings. Multicomponent fibers of two materials having disparate melting points for forming point bonded nonwovens are known, for example, from U.S. Pat. No. 4,732,809 to Harris et al. Asymmetric nylon-nylon sheath-core multicomponent fibers are known from U.S. Pat. No. 4,069,363 to Seagraves et al.

While various multicomponent fibers are known in the art, there still exists a need for multicomponent structures which enable a fiber to be "engineered" to suit particular end uses. It is towards providing such a fibre that the present invention is directed.

Broadly, the present invention is directed to multicomponent fiber having a primary core, and multiple secondary cores equidistantly radially spaced from one another and from the primary core. The primary and secondary cores are entirely embedded within (and thus completely encased by) a primary sheath. Optionally, the primary sheath may be entirely or partly surrounded by a secondary sheath. Thus, according to the present invention, the primary and secondary cores may be spun from polymers having distinctly different or complementary properties which are surrounded by a sheath or sheaths formed of another polymer(s) which protects the cores.

These and other aspects and advantages of the present invention will become more clear after careful consideration is given to the detailed description of the preferred exemplary embodiments thereof which follow.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
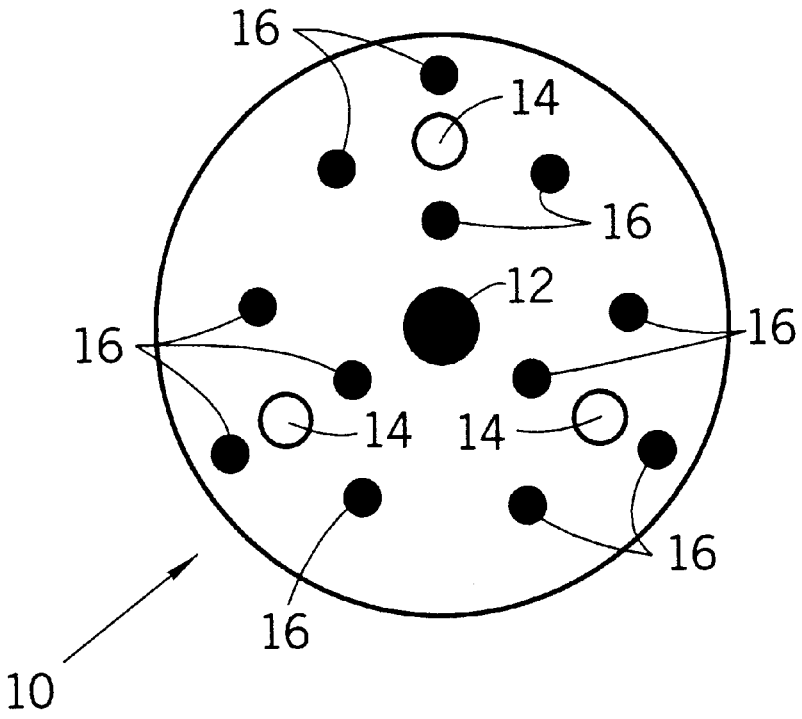
FIG. 1 is an enlarged diagrammatic plan view of a polymer flow distribution plate that may be employed in a fiber spin pack to produce a representative multicomponent fiber according to the present invention.

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%. The term "non-fiber-forming" is therefore meant to refer to amorphous (non-crystalline) linear polymers which may be formed into a fiber structure, but which are incapable of being drawn without breakage at least about 10%.

The term "fiber" includes fibers of extreme or indefinite length (filaments) and fibers of short length (staple). The term "yarn" refers to a continuous strand or bundle of fibers.

The term "multicomponent fiber" is a fiber having at least two distinct cross-sectional longitudinally coextensive domains respectively formed of different incompatible polymers. The distinct domains may thus be formed of polymers from different polymer classes (e.g., nylon and polypropylene) or be formed of polymers from the same polymer class (e.g., nylon) but which differ in their respective physical and/or chemical properties including, for example, differing relative viscosities, types or amounts of additives present, such as colorants, and the like. The term "multicomponent fiber" is thus intended to include concentric and eccentric sheath-core fiber structures, symmetric and asymmetric side-by-side fiber structures, island-in-sea fiber structures and pie wedge fiber structures. Particularly preferred according to the present invention are multicomponent sheath-core fiber structures which are suitable for use as carpet fibers having a primary sheath which entirely surrounds a concentric primary core and a number of secondary cores substantially equidistantly spaced-apart from one another and the primary core.

Virtually any fiber-forming polymer may usefully be employed in the practice of this invention. In this regard, suitable classes of polymeric materials that may be employed in the practice of this invention include polyamides, polyesters, acrylics, polyolefins, maleic anhydride grafted polyolefins, and acrylonitriles. More specifically, nylon, low density polyethylene, high density polyethylene, linear low density polyethylene and polyethylene terephthalate may be employed. Each distinct domain forming the bicomponent fibers of this invention may be formed form different polymeric materials having different relative viscosities. Alternatively, each domain in the bicomponent fiber may be formed from the same polymeric materials, provided that the polymeric materials of the respective domains exhibit different relative viscosities.

One particularly preferred class of polymers used in forming the bicomponent fibers of this invention is polyamide polymers. In this regard, those preferred polyamides useful to form the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-ε-caprolactam (nylon 6) and polyhexamethylene adipamide (nylon 6/6). Most preferred is nylon 6. The preferred polyamides will exhibit a relative viscosity of between about 2.0 to about 4.5, preferably between about 2.4 to about 4.0.

The primary and/or secondary cores of the multicomponent fibers according to this invention may also formed of an amorphous linear polymer which in and of itself is non-fiber-forming. Suitable amorphous polymers for use in the practice of this invention include polystyrene, polyisobutene and poly(methyl methacrylate). When employed in the primary and/or secondary cores, the amorphous polymer is most preferably an amorphous polystyrene, with amorphous atactic polystyrene being particularly preferred.

The multicomponent fibers are spun using conventional fiber-forming equipment. Thus, for example, separate melt flows of the polymers having different relative viscosities may be fed to a conventional multicomponent spinnerette pack such as those described in U.S. Pat. Nos. 5,162,074, 5,125,818, 5,344,297, 5,445,884 and 5,533,883 (the entire content of each patent being incorporated expressly hereinto by reference) where the melt flows are combined to form extruded multi-lobal (e.g., tri-, tetra-, penta- or hexalobal) fibers having two distinct polymer domains, for example, sheath and core structures. Preferably, the spinnerette is such that fibers having a tri-lobal structure with a modification ratio of at least about 2.0, more preferably between 2.2 and 4.0 may be produced. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section.

The extruded fibers are quenched, for example with air, in order to solidify the fibers. The fibers may then be treated with a finish comprising a lubricating oil or mixture of oils and antistatic agents. The thus formed fibers are then combined to form a yarn bundle which is then wound on a suitable package.

In a subsequent step, the yarn is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 28 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 1½ to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

Further understanding of this invention will be obtained from the following non-limiting Examples which illustrate specific embodiments thereof.

EXAMPLES

The following non-limiting example will further illustrate the present invention.

Polyethylene terephthalate (Type T782 available from Intercontinental Polymer Corporation, hereinafter referred to as "PET"), nylon 6 (Ultramid® available from BASF Corporation), black pigmented nylon 6, and polystyrene (available from BASF Corporation) are used. The polymers are extruded using equipment as described in U.S. Pat. No. 5,244,614 to Hagen (the entire content of which is expressly incorporated hereinto by reference). The relative amounts of each polymeric component are 20 wt. % PET, 35 wt. % nylon 6, 30 wt. % black pigmented nylon 6, and 15 wt. % polystyrene. Final extruder zone temperatures for each polymer are 295° C. for the PET, 275° C. for the nylon 6, 275° C. for the black pigmented nylon 6, and 260° C. for the polystyrene. The spin pack tempeature is 270° C.

The spin pack is designed using thin plates such as those described in U.S. Pat. Nos. 5,344,297, 5,162,074 and 5,551,588 each issued to Hills (the entire content of each being expressly incorporated hereinto by reference). Above the backhole leading to the spinning capillary are thin plates designed to deliver each polymer melt flow as illustrated in FIG. 1. Specifically, the thin plate 10 will include a primary core aperture 12 to receive the polystyrene component, and a series of three auxiliary core apertures 14 each being equally radially spaced from the primary aperture 12 and from one another. A series of primary sheath apertures 16 are equidistantly positioned around each of the auxiliary core apertures 14.

Figure 2:
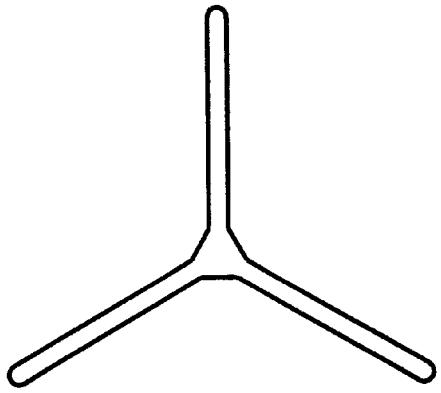
FIG. 2 is an enlarged diagrammatic plan view of a spinneret trilobal orifice configuration that may be employed downstream of the polymer flow distribution plate shown in FIG. 1.

The individual polymer flows are directed by the thin plate 10 of FIG. 1 and are processed by the apparatus disclosed in U.S. Pat. No. 2,989,789 to Bannerman (the entire content of which is expressly incorporated hereinto by reference) where the PET melt flow is fed in as a complete (secondary) sheath which completely envenlops the polymer flows through the thin plate 10. The entire flow of polymers—namely, the PET, nylon 6, black pigmented nylon 6 and polystyrene—is divided into 58 separate flows, each of which is fed into the backhole of a conventionl spinnerette opening as illustrated in FIG. 2 so as to form a corresonding number (i.e., 58) of fibers.

Figure 3:
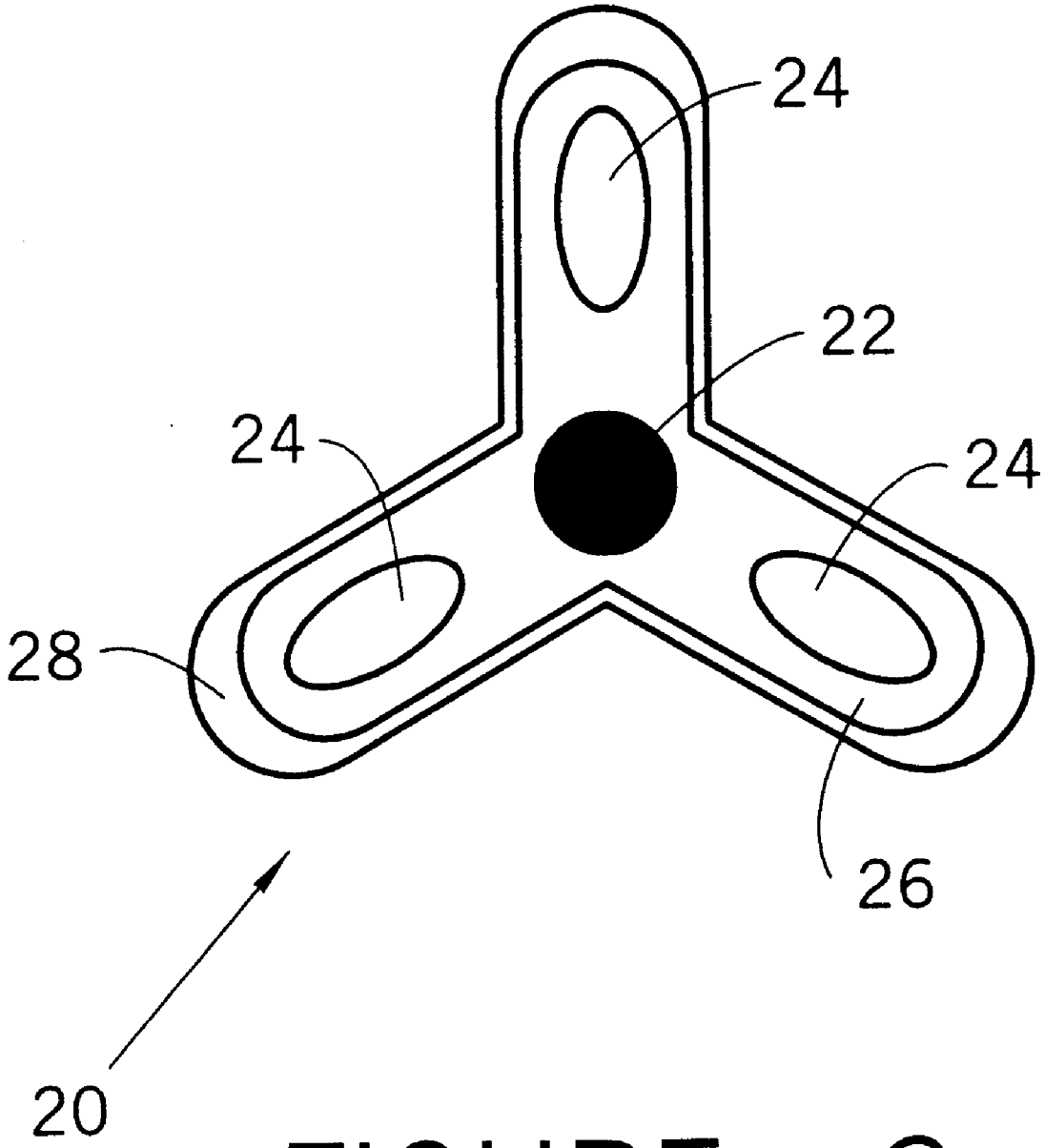
FIG. 3 is an enlarged diagrammatic cross-sectional view of one possible multicomponent fiber in accordance with this invention that may be produced using the polymer flow distribution plate and spinneret orifice depicted in FIGS. 1–2, respectively.

A cross-section of the resulting fiber 20 is shown in accompanying FIG. 3. As shown, the fiber 20 includes a central (primary) core 22 formed of the polystyrene, and three radially elongate secondary cores 24 generally centrally positioned within each of the fiber lobes and formed of the black pigmented nylon 6. These primary and secondary cores 22, 24, respectively, are entirely surronded by a primary (inner) sheath 26 of the nylon 6 polymer which, in turn, is entirely surrounded by a secondary (outer) sheath 28 of PET. Each of the domains 22–28 are longitudinally coextensive with one another along the entire length of the fiber 20.

The fibers are cooled, drawn and textured in a continuous spin-draw apparatus (Rieter J0/10) using a draw ration of 2.8 and a winding speed of 2200 meters per minute.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a multicomponent fiber comprising directing respective melt flows of different polymers to a spinnerette, forming a multicomponent fiber by extruding the different polymers through orifices of the spinnerette such that a first polymer is present as a primary core in the fiber cross-section, a second polymer is present as multiple secondary cores equidistantly spaced from one another and form said primary core in the fiber cross-section, and a third polymer is present as a primary sheath which completely surrounds said primary and secondary cores, and thereafter quenching the multicomponent fiber.

2. A method as in claim 1, which further comprises the step of drawing the multicomponent fiber at least 10%.

3. A method as in claim 1, wherein the first polymer is an amorphous non-fiber-forming polymer.

4. A method as in claim 3, wherein the first polymer is polystyrene.

5. A method as in claim 1, further comprising extruding a fourth polymer through the orifices so as to form a secondary sheath which at least partly surrounds said primary sheath.

6. A method as in claim 5, wherein said first polymer is polystyrene, said second polymer is pigmented nylon, said third polymer is non-pigmented nylon and said fourth polymer is polyethylene terephthalate.

* * * * *